US008906470B2

(12) United States Patent
Overstolz et al.

(10) Patent No.: US 8,906,470 B2
(45) Date of Patent: Dec. 9, 2014

(54) METHOD FOR PRODUCING A MICROFABRICATED ATOMIC VAPOR CELL

(75) Inventors: Thomas Overstolz, St-Blaise (CH); Jacques Haesler, Morat (CH); Vladislav Spassov, Neuchatel (CH)

(73) Assignee: CSEM Centre Suisse d'Electronique et de Microtechnique SA—Recherche et Developpment, Neuchatel (CH)

( * ) Notice: Subject to any disclaimer, the term of this patent is extended or adjusted under 35 U.S.C. 154(b) by 212 days.

(21) Appl. No.: 13/162,174

(22) Filed: Jun. 16, 2011

(65) Prior Publication Data

US 2012/0301631 A1 Nov. 29, 2012

(30) Foreign Application Priority Data

May 26, 2011 (EP) ..... 11167693

(51) Int. Cl.

| | |
|---|---|
| ***B05D 7/22*** | (2006.01) |
| ***B05D 3/04*** | (2006.01) |
| ***B05D 3/02*** | (2006.01) |
| ***B05D 3/06*** | (2006.01) |
| ***G04F 5/14*** | (2006.01) |

(52) U.S. Cl.

CPC ..... *G04F 5/14* (2013.01)
USPC ..... 427/557; 427/558; 427/309; 427/235; 427/372.2

(58) Field of Classification Search

CPC ..... G04F 5/14
USPC ..... 331/94.1; 427/229, 230, 235, 309, 427/372.2, 557, 558
See application file for complete search history.

(56) References Cited

U.S. PATENT DOCUMENTS 7,400,207 B2 * 7/2008 Lipp et al. ..... 331/94.1
2005/0007118 A1 1/2005 Kitching et al.

OTHER PUBLICATIONS

Woetzel et al; Microfabricated atomic vapor cell arrays for magnetic field measurements; Review of Scientific Instruments 82, Mar. 25, 2011.*
Knappe et al; Atomic vapor cells for chip-scale atomic clocks with improved long-term frequency stability, Optics Letters, Sep. 15, 2005, vol. 30, No. 18, pp. 2351-2353.*
Liew et al; Microfabricated alkali atom vapor cells, Applied Physics Letter, Apr. 5, 2004, vol. 84, No. 14, pp. 2694-2696.*
Knappe et al: "Atomic vapor cells for chip-scale atomic clocks with improved long-term frequency stability", Optics Letters, Sep. 15, 2005, vol. 30, No. 18, pp. 2351-2353.
Liew et al: "Microfabricated alkali atom vapor cells", Applied Physics Letter, Apr. 5, 2004, vol. 84, No. 14, pp. 2694-2696.
Fabrizio Vecchio et al: "Dispensing and hermetic sealing Rb in a miniature reference cell for integrated atomic clocks", Sensors and Actuators A: Physical, Apr. 1, 2011, XP55006154.
Lukasz Nieradko et al: "New approach of fabrication and dispensing of micromachined cesium vapor cell", Journal of Microlithography, Microfabrication, and Microsystems, vol. 7, No. 3, Jan. 1, 2008, p. 033013, XP55006160.
European Search Report, dated Sep. 2, 2011, in EP 11 16 7693.
Robert W. Carling et al.: "Thermophysics of alkali and related azides II. Heat capacities of potassium, rubidium, cesium, and thallium azides from 5 to 350 K", J. Chem. Thermodynamics, 1978, 10, 1181-1200, Received Jul. 26, 1977; in revised form Apr. 7, 1978.
Li-Anne Liew et al.: "Wafer-level filling of microfabricated atomic vapor cells based on the thin-film deposition and photolysis of cesium azide", Applied Physics Letter 90, 114106 (2007), Apr. 5, 2004, Received Dec. 22, 2006, accepted Feb. 1, 2007; published online Mar. 15, 2007.
S. Woetzel et al.: "Microfabricated atomic vapor cell arrays for magnetic field measurements" Institute of Photonic Technology, Albert-Einstein-Str. 9, D-07745 Jena, Germany, Received Aug. 6, 2010, accepted Feb. 4, 2011; published online Mar. 25, 2011.

* cited by examiner

*Primary Examiner* — Michael Wieczorek
(74) *Attorney, Agent, or Firm* — Young & Thompson

(57) ABSTRACT

The present invention relates to a method for producing a microfabricated atomic vapor cell, including a step of forming at least one cavity in a substrate and closing the cavity at one side. The method further includes: —a step of depositing a solution including an alkali metal azide dissolved in at least one of its solvents, —a step of evaporating such solvent for forming a recrystallized alkali metal azide, —a step of decomposing the recrystallized alkali metal azide in an alkali metal and nitrogen, such alkali metal depositing in the cavity of the substrate.

13 Claims, 1 Drawing Sheet

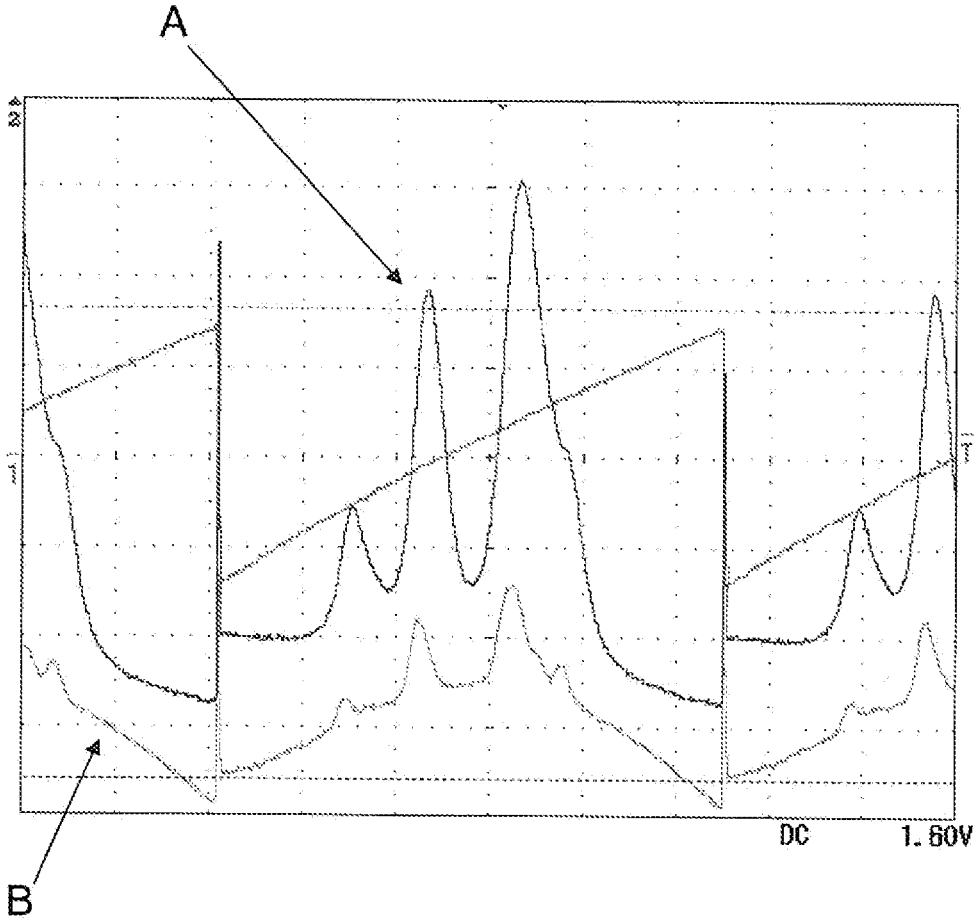
A
B
DC
1.60V

METHOD FOR PRODUCING A MICROFABRICATED ATOMIC VAPOR CELL

TECHNICAL FIELD

The present invention relates to a method for producing a microfabricated atomic vapor cell, comprising a step of forming at least one cavity in a substrate.

BACKGROUND OF THE INVENTION

Miniaturized atomic clocks characterized by a small size and a drastically reduced power consumption compared to standard atomic clocks exhibit an increasing interest mainly for applications in portable devices. The unprecedented frequency stability of atomic clocks is achieved by a suitable interrogation of optically excited atoms which takes place in the so-called vapor cell, the heart of an atomic clock. The vapor cell consists of a sealed cavity which contains small amounts of an alkali metal, preferably rubidium or cesium, a buffer gas and/or an anti-relaxation coating. MEMS (Microelectromechanical systems) technology allows the fabrication of miniaturized vapor cells having a volume in the range of a few cubic millimeters. The fabrication of vapor cells typically consists in etching through holes into a substrate, as a silicon wafer, bonding a glass wafer onto one side of the silicon wafer, filling the cavity with an alkali metal, and closing the cavity by bonding a second glass wafer on the other side of the silicon wafer. Such a method is disclosed for example in the patent publication US 2005/0007118. The difficulties encountered during the fabrication of vapor cells are related to the volatile character of alkali metals and to the reactivity of alkali metals with oxygen. As a result, all handling of alkali metals has to be done either under high vacuum conditions or in an anaerobic atmosphere, a fact that complicates the fabrication of alkali metal vapor cells.

Several fabrication approaches have been reported which can be categorized in four different groups:

a) cell filling using commercially available alkali metal dispensers;

b) cell filling using the chemical reaction of barium azide and rubidium or cesium chloride producing metallic rubidium or cesium, barium chloride, and elementary nitrogen. The chemical reaction can take place in situ or ex situ;

c) cell filling using alkali metal azide deposited by vacuum thermal evaporation followed by thermal- or UV-decomposition to produce pure alkali metal and elementary nitrogen. The decomposition can take place in situ or ex situ;

d) electrolytic decomposition of alkali metal enriched glass.

From the four cell filling approaches a) to d), methods b) to d) can be potentially scaled-up to wafer-level filling. Li-Anne Liew et al., in the publication "Microfabricated alkali atom vapor cells", Appl. Phys. Lett., Vol. 84, No. 14, 5 Apr. 2004, describe a cell filling method using an aqueous solution of dissolved $BaN_6$ and CsCl and further in situ chemical reaction to form BaCl, metallic Cs, and nitrogen (method b). A disadvantage of such method is that unreacted Ba tends to form different forms of nitride with the released nitrogen, causing pressure fluctuation inside the cell which affects the stability of the atomic clock, as disclosed by S. Knappe et al. in the publication "Atomic vapor cells for chipscale atomic clocks with improved long-term frequency stability", Opt. Lett. 30, 2351-3.

Li-Anne Liew et al., in the publication "Wafer-level filling of microfacricated atomic vapor cells based on the thin-film deposition and photolysis of cesium azide", Appl. Phys. Lett. 90, 114106 (2007), describe a method for thin-film deposition of cesium azide ($CsN_3$) by vacuum thermal evaporation using custom built evaporation equipment and further in situ decomposition (method c). However, this method is hazardous since, for thermal evaporation, the azide has to be heated above its melting point, favoring uncontrolled decomposition and explosion.

For batch fabrication, the cell filling by manually placing solid crystals of alkali metal azide into cavities is cumbersome and an accurate control of the deposited amount of azide is impossible. The method described in the publication of Li-Anne Liew et al. cited above solves some of these challenges but suffers from cost and danger related disadvantages.

Hence methods have to be found that allow an easy, cost effective and precise cell filling.

SUMMARY OF THE INVENTION

The present invention provides a method for producing a microfabricated atomic vapor cell which allows to avoid the disadvantages of the prior art.

Accordingly, the present invention relates to a method for producing a microfabricated atomic vapor cell, comprising a step of forming at least one cavity in a substrate, and closing the cavity at one side, wherein it further comprises:

- a step of depositing a solution comprising an alkali metal azide dissolved in at least one of its solvents,
- a step of evaporating such solvent for forming a recrystallized alkali metal azide,
- a step of decomposing said recrystallized alkali metal azide in an alkali metal and nitrogen, such alkali metal depositing in the cavity of the substrate.

Advantageously, the solvent may be water.

In a first embodiment using an in situ decomposition, the solution comprising the alkali metal azide may be deposited into the cavity of the cell. Then the method further comprises, before the step of decomposing the recrystallized alkali metal azide in an alkali metal and nitrogen, a step of sealing the cavity under controlled atmosphere and pressure.

In another embodiment using an ex situ decomposition, the solution comprising the alkali metal azide may be deposited into a cavity formed in an intermediate substrate. Then the method further comprises:

- a step of aligning the cavity of the intermediate substrate with the cavity of the cell substrate, and
- after the step of decomposing the recrystallized alkali metal azide formed in the cavity of the intermediate substrate, allowing a deposit of an alkali metal in the cavity of the cell substrate, a step of sealing said cavity of the cell substrate under controlled atmosphere and pressure.

The present invention presents several advantages:

- alkali metal azides are known to yield high purity alkali metals upon decomposition;
- alkali metal azides can be handled under normal atmospheric conditions;
- as a result, the method of alkali metal azide deposition is easily scalable to wafer-level filling.

BRIEF DESCRIPTION OF THE DRAWINGS

FIG. 1 shows a print screen of a typical absorption spectra of miniaturized vapor cell fabricated according to the invention and of a commercially available macroscopic reference Rb cell.

DETAILED DESCRIPTION

The present invention relates to a method for producing a microfabricated atomic vapor cell, comprising a step of forming at least one cavity in a substrate.

Traditionally, the method comprises a step of forming cavities into a substrate, as a silicon wafer, and a step of bonding a first glass wafer onto one side of the silicon wafer.

The cavities may by formed by etching. As such technologies are known from one skilled in the art, no further detailed description is needed.

According to the invention, the cavities may be filled with an alkali metal by two ways, the first one is used for further in situ alkali metal azide decomposition and the second one is used for further alkali metal azide ex situ decomposition.

According to a first embodiment, the method of the invention comprises:

- a step of depositing a solution of an alkali metal azide dissolved in at least one of its solvents, in the cavities of the silicon wafer,
- a step of evaporating such solvent for forming a recrystallized alkali metal azide,
- a step of sealing the cavities containing the recrystallized alkali metal azide by bonding a second glass wafer on the other side of the silicon wafer, and
- a step of decomposing said recrystallized alkali metal azide in an alkali metal and nitrogen, in such a way that the cavities of the silicon wafer are filled with the released corresponding alkali metal.

Small volumes in the sub-microliter range of the alkali metal azide solution are dispensed at wafer-level into the cavities using standard micropipettes (manually or automated). The high precision of the dispensed quantity of liquid allows an accurate control of the amount of deposited alkali metal azide.

Due to the small volume of solution deposited in each cavity, the solvent medium is evaporated rapidly at room temperature or under slight heating, leaving a uniform layer of recrystallized alkali metal azide.

Encapsulation of the recrystallized alkali metal azide is performed by anodic bonding of a top glass wafer under controlled atmosphere and pressure, as known from one skilled in the art.

According to a second embodiment, the method of the invention comprises:

- a step of depositing a solution of an alkali metal azide dissolved in at least one of its solvents, in cavities formed in an intermediate substrate,
- a step of evaporating such solvent for forming a recrystallized alkali metal azide in said cavities formed in the intermediate substrate,
- a step of aligning the cavities of the intermediate substrate with the cavities of the silicon wafer,
- a step of decomposing said recrystallized alkali metal azide formed in the cavities of the intermediate substrate, in an alkali metal and nitrogen, allowing a deposit of the corresponding alkali metal in the corresponding cavities of the silicon wafer, and
- a step of sealing the cavities of the silicon wafer containing the released alkali metal by bonding a second glass wafer on the other side of the silicon wafer under controlled atmosphere and pressure.

Advantageously, the intermediate substrate may be an array of micro containers. The alkali metal azide solution may be used to fill such micro containers by simply dipping the micro containers into the alkali metal azide solution. The micro containers can be made of cavities, small capillaries, partially hollowed pillars or partially hollowed fibers which volume precisely determines the quantity of adsorbed alkali metal azide solution.

Then, the intermediate substrate containing the array of micro alkali metal azide containers is dried (solvent evaporation) and aligned with the wafer of micro cavities etched in silicon. Pure alkali metal is released ex situ by decomposition of the alkali metal azide present in the micro containers and condensed in each corresponding micro cavity of the silicon wafer.

Encapsulation of the alkali metal, which has condensed in the cavities of the silicon wafer, is performed by anodic bonding of a top glass wafer under controlled atmosphere and pressure, as known from one skilled in the art.

The intermediate substrate can be rinsed and reused or stocked until a further use.

More generally, in both embodiments of the invention, the step of evaporating the solvent may be carried out by drying the deposited alkali metal azide at a temperature comprised between 25° C. and 315° C., and preferably between 100° C. and 300° C., under a pressure comprised between 1013.25 mbar (normal atmospheric pressure) and $10^{-6}$ mbar, and preferably between $10^{-3}$ mbar and $10^{-5}$ mbar. The duration of the evaporation is comprised between 15 minutes and 1 day, and preferably between 1 hour and 2 hours.

Advantageously, the step of evaporating the solvent can be handled under normal atmospheric pressure (1013.25 mbar) and at room temperature (25° C.).

Preferably, in both embodiments of the invention, the step of eliminating the solvent trapped in the recrystallized alkali metal azide may be carried out by gently heating the recrystallized alkali metal azide under vacuum, starting at room temperature and increasing the temperature to a value slightly below the melting point of the corresponding alkali metal azide. The duration of said baking is long enough in such a way that the deposited alkali metal azide is dried and no water is trapped in the sealed final cell.

Preferably, in the first embodiment of the invention, the step of sealing the cavity is executed while the recrystallized alkali metal azide is kept at a sufficiently high temperature in order to avoid re-hydration.

Preferably, the decomposition of the recrystallized alkali metal azide in an alkali metal and nitrogen may be a thermal decomposition or is carried out by UV irradiation.

The $N_2$ released serves as a buffer gas in the final cell.

Advantageously, the solvent used for dissolving the alkali metal azide is a polar aprotic solvent, in which the alkali metal azide is at least partially soluble. Preferably, the solvent evaporates without any eutectic.

The solvent can be chosen according to the solubility of the alkali metal azide in order to obtain the required amount of deposited alkali metal azide.

Preferably, the solvent may be selected from the group comprising water, alcohols, acetone, acetonitrile, dioxane, tetrahydrofuran (THF), dimethyl sulfoxide (DMSO), and mixtures thereof.

Advantageously, the solvent may be deionized water.

The alkali metal used in the present invention belongs to the elements of the first group of the periodic system.

Preferably, the alkali metal may be selected from the group comprising cesium and rubidium.

The alkali metal azides usable in the invention, as $RbN_3$, isotopically enriched $^{85}RbN_3$ and $^{87}RbN_3$, or $CsN_3$, are then dissolved in an appropriate solvent, as described above.

Tests have shown that dissolved $RbN_3$ or $CsN_3$ does not transform and/or hydrolize when working sufficiently fast, and recrystallized $RbN_3$ or $CsN_3$ decomposes, thermally or by UV irradiation, into metallic rubidium or cesium and nitrogen as good as the original salt.

The new method of invention allows the deposit of precise quantities of alkali metal azide in a fast, safe, low-cost, and simple way, without the need for expensive custom made equipment.

Surprisingly, the method of the invention comprises a step of dissolving alkali metal azide in water or other appropriate solvent for liquid transfer of dissolved solution and subsequent evaporation of the solvent medium. Indeed one skilled in the art would not have chosen this approach but rather try to avoid as much as possible any contact of alkali metal azide with humidity or even with water, considering the hygroscopic property of alkali metal azides, as disclosed by Robert W. Carling and al, in "Thermophysics of alkali and related azides II. Heat capacities of potassium, rubidium, cesium, and thallium azides from 5 to 350 K", J. Chem. Thermodynamics, 1978, 10, 1181-1200.

The reason is that once the alkali metal azide is decomposed into alkali metal and nitrogen inside the hermetically sealed vapor cell, the alkali metal reacts very violently with trapped water, producing hydrogen and alkali metal hydroxide. For a vapor cell used in an atomic clock, this is not acceptable even if only part of the alkali metal is transformed into hydroxide, since the pressure fluctuation due to hydrogen formation would heavily affect the long term stability of such a clock.

The method of the invention comprising a step of baking the recrystallized alkali metal azide as described above does not suffer from such a problem.

Vapor cells based on the technique of cell filling according to this invention can be used in all applications where the spectroscopic properties of alkali vapor can be exploited, for example in atomic clocks, or in magnetometers.

The following examples illustrate the present invention without however limiting its scope.

EXAMPLE

A quantity of 100 mg of $RbN_3$ was deposited in a polypropylene vial, and 1 ml of DI water was filled into the vial. The vial was then agitated until the $RbN_3$ was completely dissolved after about 1 min. A Gilson micropipette, model P2, was adjusted to a quantity of 200 nl. Using the micropipette and a polypropylene barrier tip mounted onto it, 200 nl of aqueous solution was taken from the vial and deposited into a cavity formed by pits etched into a silicon wafer and closed at the bottom by a glass wafer. The dimensions of the cavities were $5\times5\times1$ $mm^3$. The step of pipetting was repeated until dissolved rubidium azide solution was dispensed in all cavities of the wafer. The stack of the bonded wafer pair was then placed on the chuck of the bonding machine, and a top glass wafer was positioned above the stack on 3 flags which are used to separate the top glass wafer from the stack of the already bonded wafer pair. The bonding chuck was then placed in the bonding machine. The chamber of the bonding machine was evacuated to a pressure of $1\cdot10^{-4}$ mbar which took about 2 hours. In the mean time, the bonding chuck was gently heated, first to 180° C. for 1 hour, then to 280° C. for another hour. The heating ramp was in both cases 10° C./min. During this bake, one can clearly detect—upon reaching the end temperature of the two heating phases—a pressure increase, indicating the evaporation of residual solvent from the recrystallized $RbN_3$. Upon reaching a pressure of $1\cdot10^{-4}$ mbar, the pump was switched off, and the bonding chamber was backfilled with Ar to a pressure of 16 mbar. Then, the anodic bonding was launched. As part of the anodic bonding process, the 3 flags were removed resulting in direct contact of the top glass wafer with the bonded wafer pair, and a pressure of 1000 N was applied to the triple wafer stack. A relatively low bonding voltage of 220 V was applied for 45 min. The low bonding voltage is required in order to avoid any discharge between the high voltage electrodes due to the low pressure inside the bonding chamber. After bonding, the triple wafer stack was diced into single cells of $10\times10\times2$ $mm^3$. The cells were then placed in a custom made UV chamber in order to decompose the $RbN_3$. The chamber was equipped with two low pressure mercury TUV lamps (Philips Electronics N.V.) emitting light at 254 nm. After at least 16 hours of irradiation, enough $RbN_3$ was decomposed to clearly measure the absorption spectra of buffered Rb vapor.

FIG. 1 shows a print screen of a typical absorption spectra of such a cell where the horizontal axis corresponds to the frequency scan of the laser exiting the Rb atoms, and the vertical axis corresponds to the transmission intensity of the laser. The upper graph A is the absorption spectra of a miniaturized vapor cell fabricated according to above example of the invention; the lower graph B is the absorption spectra of a commercially available macroscopic reference Rb cell.

The invention claimed is:

1. Method for producing a microfabricated atomic vapor cell, comprising a step of forming at least one cavity in a substrate, said substrate being a silicon wafer, and closing the cavity at one side by bonding a glass wafer onto said side, wherein it further comprises:

a step of depositing a solution comprising a rubidium metal azide dissolved in at least one solvent selected from the group consisting of deionized water and alcohols, a step of evaporating the solvents to form a recrystallized rubidium metal azide, a step of decomposing said recrystallized rubidium metal azide into rubidium metal and nitrogen, such rubidium metal depositing in the cavity of the substrate.

2. Method according to claim 1, wherein the step of evaporating the solvent is carried out by drying the deposited solution at a temperature between 100° C. and 300° C., under a pressure between $10^{-3}$ mbar and $10^{-5}$ mbar.

3. Method according to claim 1, wherein the duration of the evaporation is between 15 minutes and 1 day.

4. Method according to claim 1, wherein the decomposition of the recrystallized rubidium metal azide into rubidium metal and nitrogen is a thermal decomposition.

5. Method according to claim 1, wherein the step of decomposing the recrystallized rubidium metal azide into rubidium metal and nitrogen is carried out by UV irradiation.

6. Method according to claim 1, wherein the solvent is an alcohol.

7. Method according to claim 1, wherein the solvent is deionized water.

8. Method according to claim 1, wherein the solution comprising the rubidium metal azide is deposited into the cavity of the substrate, and wherein the method further comprises, before the step of decomposing the recrystallized rubidium metal azide into rubidium metal and nitrogen, a step of sealing the cavity.

9. Method according to claim 8, wherein the step of sealing the cavity is executed while the recrystallized rubidium metal azide is kept at a sufficiently high temperature in order to avoid re-hydration.

10. Method according to claim 8, wherein the step of evaporating the solvent is carried out by drying the deposited solution at a temperature between 100° C. and 300° C., under a pressure between $10^{-3}$ mbar and $10^{-5}$ mbar.

11. Method according to claim 10, wherein the duration of the evaporation is between 15 minutes and 1 day.

12. Method according to claim 8, wherein the decomposition of the recrystallized rubidium metal azide into rubidium metal and nitrogen is a thermal decomposition.

13. Method according to claim 8, wherein the step of decomposing the recrystallized rubidium metal azide into rubidium metal and nitrogen is carried out by UV irradiation.

* * * * *